US005453147A

United States Patent [19]

Chow

[11] Patent Number: 5,453,147

[45] Date of Patent: Sep. 26, 1995

[54] METHOD FOR ATTACHING WOVEN CLOTH TO A WOOD PLATE

[76] Inventor: Yung H. Chow, No. 14, 108 Lane, Chia Ho Road, Ho-Li Hsiany, Taichung Hsien, Taiwan, Prov. of China

[21] Appl. No.: 368,156

[22] Filed: Dec. 29, 1994

[51] Int. Cl.[6] ..... B32B 31/00

[52] U.S. Cl. ..... 156/248; 156/250; 156/267; 156/280; 156/344

[58] Field of Search ..... 156/248, 250, 156/267, 344, 280

*Primary Examiner*—Chester T. Barry
*Attorney, Agent, or Firm*—Charles E. Baxley

[57] ABSTRACT

A method for attaching a woven cloth layer to a wood plate includes applying an adhesive material onto the wood plate for securing the woven cloth layer onto the wood plate. One or more layers of painting materials are applied onto the woven cloth layer and a membrane is applied onto the painting materials. The peripheral portion of the woven cloth layer is cut so as to form the marginal portion of the wood plate. One or more layers of painting materials are applied onto the marginal portion so as to form a table top. The table top can be easily and quickly manufactured.

1 Claim, 1 Drawing Sheet

METHOD FOR ATTACHING WOVEN CLOTH TO A WOOD PLATE

BACKGROUND OF THE INVENTION

1. Field of the Invention

The present invention relates to a method, and more particularly to a method for attaching a woven cloth sheet to the surface of a wood plate.

2. Description of the Prior Art

Typical tables comprise a table top that is simply painted with suitable paint materials for protecting the table top. It is difficult to apply suitable graph to the table top.

The present invention has arisen to mitigate and/or obviate the afore-described disadvantages of the conventional tables.

SUMMARY OF THE INVENTION

The primary objective of the present invention is to provide a method for attaching a woven cloth sheet to the table top so as to provide suitable graph on the table top.

In accordance with one aspect of the invention, there is provided a method for attaching a woven cloth layer to a wood plate, the woven cloth layer including a peripheral portion, and the wood plate including an upper surface having a marginal portion. The method comprises applying an adhesive material onto the upper surface of the wood plate, applying the woven cloth layer onto the adhesive material for securing the woven cloth layer onto the upper surface of the wood plate, applying at least one layer of painting material onto the woven cloth layer, applying a membrane material onto the painting material for protecting the painting material and the woven cloth layer, cutting the peripheral portion of the woven cloth layer so as to form the marginal portion of the wood plate, applying at least one layer of painting material onto the marginal portion, and disengaging the membrane material from the woven cloth layer so as to form a table top to be made.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
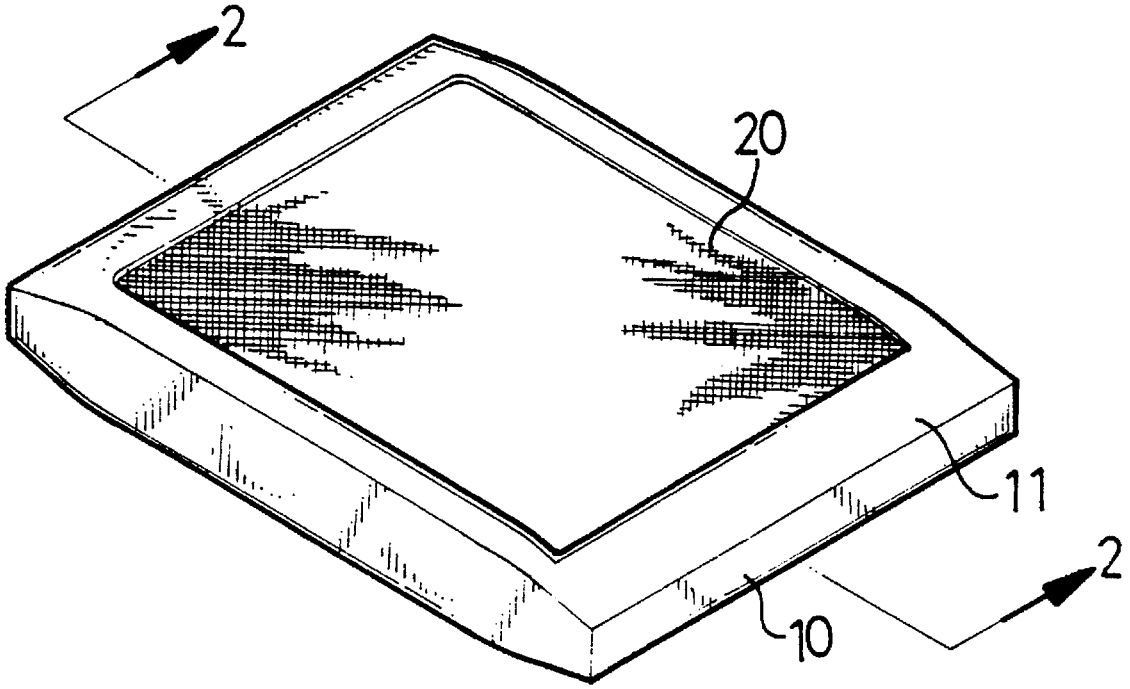
FIG. 1 is a perspective view of a table top to be manufactured by the method in accordance with the present invention.
Figure 2:
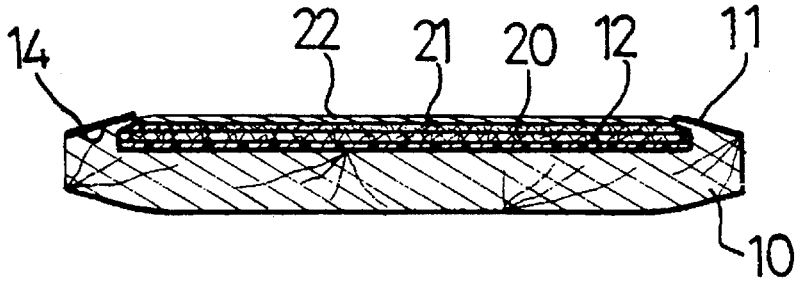
FIG. 2 is a cross sectional view of the table top.

Referring to the drawings, and initially to FIG. 1, a method in accordance with the present invention is provided for attaching or securing a woven cloth sheet 20 onto a wood plate 10. The woven cloth sheet 20 may include suitable patterns, graphs or colors for decorating the wood plate 10 or the table top. It is required to form a margin 11 on the peripheral portion of the wood plate 10. Referring next to FIG. 2, the method in accordance with the present invention includes a resin or adhesive material layer 12 applied to the upper surface of the wood plate 10 for adhering and securing the woven cloth sheet 20 to the wood plate 10. It is preferable that at least 24 hours are provided for drying the adhesive material. One or more layers of painting materials 21 are applied onto the woven cloth sheet 21, and a protective film or membrane material 22 is further applied above the painting layer 21 for protecting the painting material and the woven cloth layer 20.

The peripheral portion of the woven cloth sheet 20 is then cut to form the marginal portion 11 of the wood plate 10, and one or more painting materials 14 are further applied onto the marginal portion 11 for finishing the marginal portion 11. Finally, the film or membrane 22 is disengaged from the woven material sheet 20 so as to form the table top to be made.

Accordingly, the woven cloth material 20 can be easily and quickly secured to the wood plate 10 with the method in accordance with the present invention. In addition, the table top manufactured by the method in accordance with the present invention may include an upper surface decorated by the patterns, graphs and colors of the woven cloth sheet.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for attaching a woven cloth layer to a wood plate, said woven cloth layer including a peripheral portion, and said wood plate including an upper surface having a marginal portion, said method comprising:

applying an adhesive material onto said upper surface of said wood plate, applying said woven cloth layer onto said adhesive material for securing said woven cloth layer onto said upper surface of said wood plate, applying at least one layer of painting material onto said woven cloth layer, applying a membrane material onto said painting material for protecting said painting material and said woven cloth layer, cutting said peripheral portion of said woven cloth layer so as to form said marginal portion of said wood plate, thereafter applying at least one layer of painting material onto said marginal portion, and thereafter disengaging said membrane material from said woven cloth layer so as to form a table top.

* * * * *